United States Patent [19]

Kawasaki

[11] 4,326,479

[45] Apr. 27, 1982

[54] MOVABLE SKEG FOR NON-PROPELLED BARGES

[76] Inventor: Masasuke Kawasaki, 1002 Michigan Ave., Slidell, La. 70458

[21] Appl. No.: 140,963

[22] Filed: Apr. 17, 1980

[51] Int. Cl.[3] ..... B63B 21/00

[52] U.S. Cl. ..... 114/248; 114/126; 114/249

[58] Field of Search ..... 114/242, 246, 248, 249, 114/77 R, 126

[56] References Cited

U.S. PATENT DOCUMENTS

| | | | |
|---|---|---|---|
| 2,411,156 | 11/1946 | Grimminger | 114/246 |
| 2,984,202 | 5/1961 | Lunde | 114/235 |
| 3,200,782 | 8/1965 | Walden et al. | 114/66.5 |
| 3,257,985 | 6/1966 | Glosten | 114/235 |
| 3,257,986 | 6/1966 | Glosten | 114/235 |
| 3,310,019 | 3/1967 | Standridge et al. | 114/246 |
| 3,516,100 | 6/1970 | Ellis | 9/310 |
| 3,568,621 | 3/1971 | Kawasaki | 114/235 |
| 3,613,622 | 10/1971 | Bueller | 114/66.5 H |
| 3,651,778 | 3/1972 | Derecktor | 114/235 R |
| 3,726,248 | 4/1973 | Glosten | 114/235 R |
| 3,892,195 | 7/1975 | Janssen | 114/235 R |

FOREIGN PATENT DOCUMENTS 194923 7/1963 Sweden .

OTHER PUBLICATIONS

The Control of Yaw in Towed Barges–Harry Benford.

*Primary Examiner*—Frank Sever
*Attorney, Agent, or Firm*—Arnold, White & Durkee

[57] ABSTRACT

An apparatus is disclosed for decreasing yaw of a first vessel when the first vessel is pulled by a second vessel which may alternatively be positioned to lessen water resistance when the first vessel is pushed by the second vessel. The apparatus includes a fin movably secured to the first vessel such that the fin may be moved from a first position wherein the fin is in the water to decrease yaw to a second position wherein water resistance is lessened. The apparatus may further provide a linkage for coupling the first and second vessels wherein the apparatus permits freedom of movement of the first vessel relative to the second for pitching, heaving, and, if desired rolling motions when the vessels are coupled and further functions as a skeg for the first vessel when the first is pulled by second vessel.

23 Claims, 5 Drawing Figures

MOVABLE SKEG FOR NON-PROPELLED BARGES

BACKGROUND OF THE INVENTION

The invention relates to apparatus for towing seagoing vessels and more particularly it relates to linkages and skegs for utilization during the towing of non-propelled barges.

In the past, non-propelled barges have been transported through the water by either "pushing" the barge from the stern by a tugboat or pulling the barge at the end of a line from the bow or one side. The former method was usually accomplished by connecting the tugboat to the stern of a barge by a suitable linkage such as is illustrated in applicant's U.S. Pat. No. 3,568,621, which is incorporated by reference. The combined structure would then act as one and navigation would be accomplished through controls on the tugboat.

Barges pulled on a line, however, are free to oscillate from side to side (yaw). If the amplitude of oscillation were small, then the condition was not serious. At times, though, a yawing barge could swing in a path having a width two to three times the length of the barge. This substantial yawing has been known to capsize tugboats and even barges.

To overcome this problem, "skegs" are included on many non-motorized barges wherein towing of the barge by pulling is anticipated. (Skegs are fin-like protrusions, usually attached as a parallel pair to the stern of the barge, which have a substantially vertical orientation and which are substantially aligned with the path of travel.) While skegs helped reduce yawing drastically, they also offer additional water resistance.

Hence, to provide an improved apparatus for barges which are towed both by pushing and pulling, it is desirable to provide a device which minimizes water resistance when the barge is pushed and which functions as a stabilizing skeg to reduce yawing by the barge when it is pulled.

SUMMARY OF THE INVENTION

The present invention provides an apparatus which functions as a skeg for a first vessel when the first vessel is pulled by a second vessel and which is further positionable such that water resistance is minimized when the first vessel is pushed by a second vessel. More particularly, the present invention provides an apparatus which functions as a skeg for a non-propelled barge when the barge is pulled by a tugboat and which may be positioned such that water resistance due to either the apparatus or the bow of the tugboat is lessened when the barge is pushed by a tugboat.

The apparatus includes a fin secured to the first vessel such that the fin may be positioned in the water to function as a skeg for the first vessel when it is pulled and such that the skeg may be positioned, when the first vessel is pushed, to lessen the water resistance normally attributable to skegs.

In a preferred embodiment, the present invention provides an apparatus which functions to couple a first and second vessel for pushing of the first vessel by the second vessel where in the apparatus permits freedom of movement between the two vessels for pitching, heaving, and, if desired rolling. The apparatus includes a frame secured to the stern of the barge which comprises a plurality of arms extending rearwardly from the barge such that the arms provide support on both sides of the tugboat when engaged for pushing the barge. (It has generally been found that the best support for a tugboat when pushing a barge is provided by an apparatus having a linkage extending to both sides of the tugboat.) A skeg member is either secured to the frame or is formed integrally with the frame and a linkage is provided between the frame and the stern to permit the skeg member to be moved from a first position, wherein the skeg member is in the water, to a second position, wherein the skeg member is out of the water when the frame is secured to the second vessel.

It should be understood that when the skeg member is designated as riding in the water, it may actually ride in a semi-submerged condition. The skeg member must only be in the water at sufficient depth to effectively act as a skeg when the barge is being pulled. By the same token, when the skeg member is designated as being out of the water, the skeg may actually be partially in the water, but the amount which is in the water will be such that it minimizes drag.

In a preferred embodiment of the present invention, the frame may comprise two arms symmetrically disposed relative to the sides of the tugboat. These arms may be connected to a single frame or may be included in a dual framework. In this embodiment, each arm further comprises a skeg member depending therefrom. The skeg may either be attached to the arm or it may be formed integrally with the arm such that the skeg, itself, forms the arm. The frame will therefore provide the twin skeg feature commonly found to be the most effective at minimizing yaw when it is positioned with the skeg below the water for pulling of the barge.

In an alternative aspect of the preferred embodiment, the apparatus includes two independent arms extending rearwardly from the stern of the barge, with each arm having a skeg member either attached thereto or formed integrally therewith as described above. A linkage is included between each arm and the stern of the barge to permit the respective skeg member to be positioned either below the water or above the water for the pulling or pushing of the barge.

In another aspect of the present invention, the linkage comprises a means for pivotally securing the frame to the stern of the barge, with the pivotal connections positioned along an axis substantially parallel to the waterline such that rotation of the frame around that axis is accommodated. The frame may further include a universal connector secured to each arm for accommodating connection of the arm to the tugboat such that freedom of movement of the tugboat for pitching, heaving, and, if preferred, rolling in relation to the barge is provided.

In a more preferred embodiment of the present invention, the frame includes two arms wherein a skeg forms the inner member of each of the arms, the arms having a triangular configuration having a first corner point located in the skeg proximate to the point of securing the arms to the second vessel and second and third corner points along the stern of the barge. A connecting linkage may further be included to provide adjustability for fastening the arm to the tugboat, the linkage being pivotally secured to the inner side of each skeg such that it pivots inwardly from the frame to contact the tugboat. A universal joint may then be provided for each connecting linkage in order to provide freedom of motion of limited magnitude to the tugboat in relation to the barge when the arms are connected in place.

In another aspect of the present invention, the apparatus may include a bottom assembly wherein the bottom assembly provides a substantially continuous surface between the tugboat and the barge in order to decrease water resistance around the bow of the tugboat.

Accordingly, the present invention overcomes the previously discussed problems of increased water resistance during pushing and the inadequate control of the yaw during pulling through a device which may function both as a connecting linkage between a tugboat and a barge to accommodate pushing the barge and as a skeg for guidance when the barge is pulled.

BRIEF DESCRIPTION OF THE DRAWINGS

This invention will further be illustrated by reference to the appended drawings which illustrate a particular embodiment of the skeg-linkage device in accordance with this invention.

DESCRIPTION OF THE PREFERRED EMBODIMENTS

The preferred embodiment is generally represented by a pair of opposing arms secured to the stern of the barge and extending rearwardly symmetrically to the opposite sides of the tugboat. While in the preferred embodiment, these arms function alternatively as skegs and as a linkage between a barge and a pushing tugboat, the arms may comprise only skegs which may be removed from the water when the barge is towed by pushing. Additionally, as will be understood by those of skill in the art these arms could be incorporated into a single frame secured to the stern of the barge. Further, so long as adaptation of the skeg members to prevent yawing is accommodated, the symmetry of the arms may be eliminated.

Figure 1:
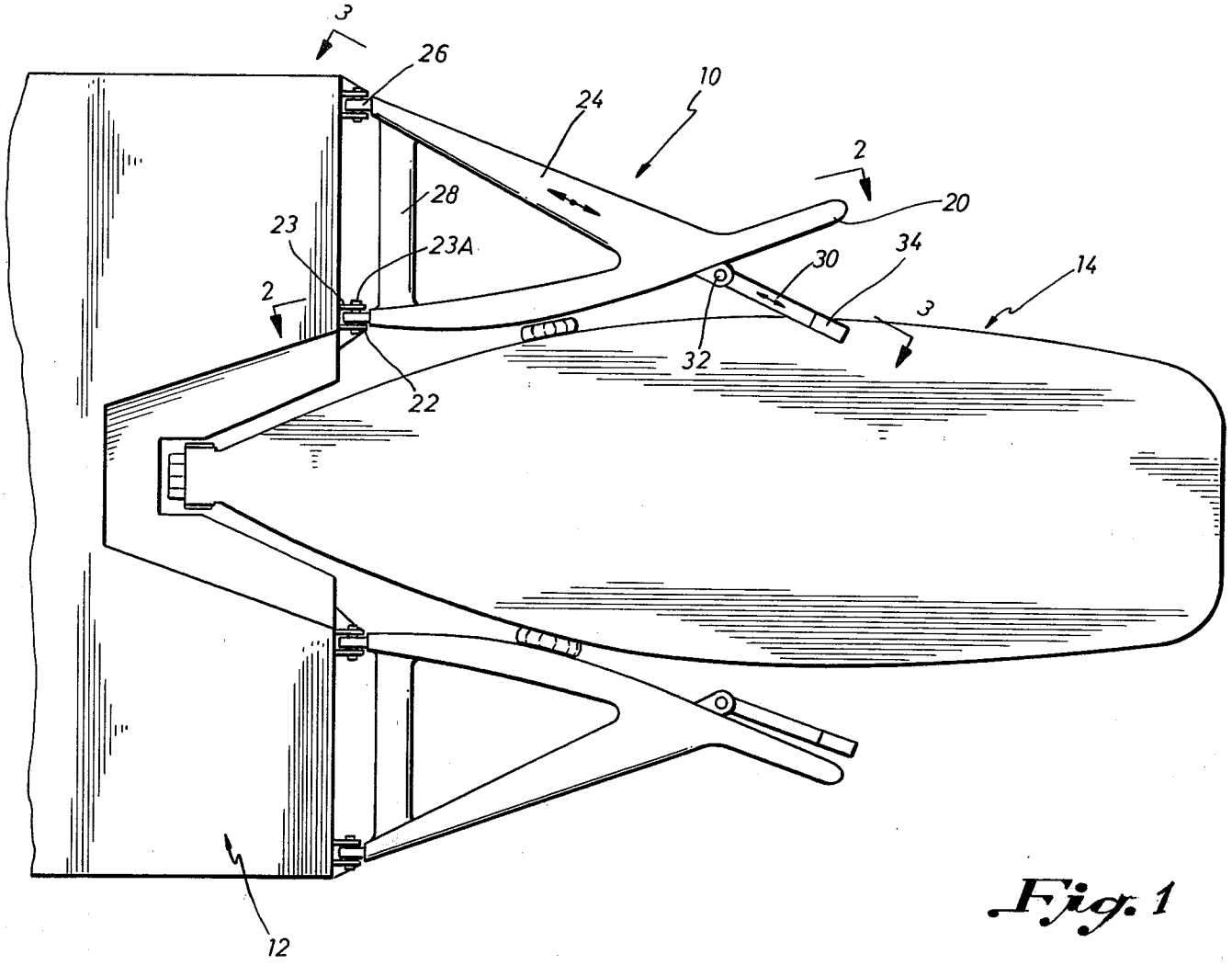
FIG. 1 is a plan view illustrating a pair of independent arms secured to the stern of a barge with a tugboat in position between them for pushing the barge.

While the preferred embodiment comprises a pair of opposing arms, only one arm will be described herein, with it being understood that the description may apply to both arms as illustrated in FIG. 1.

The preferred embodiment is represented by a skeg-linkage arm 10 connected to the stern of a barge 12 such that connection of the skeg-linkage device 10 to a tugboat 14 is accommodated.

The barge 12 may be any of a number of suitable non-propelled barges which may be pulled by a line connected between the barge and a tugboat and which may also be pushed from the rear when engaged by a tugboat 14. A recess may be included in the stern of the barge 12 in order to accommodate either the bow of the tugboat 14 or a protrusion from the tugboat 14 such that alignment of the barge and tugboat is accommodated. It will be understood, however, that tugboats and barges lacking such protrusions and matching recesses may also be utilized in accordance with the present invention.

The skeg-linkage arm 10 is comprised of a skeg 20, a connector 22 for movably securing the skeg 20 to the barge 12, a twin bracing support 24 extending angularly between the barge 12 and the skeg 20, an opposing connector 26 for movably securing the bracing support 24 to the barge 12, a cross support 28 secured between the skeg 20 and the bracing support 24, a connecting linkage 30, a third connector 32 for securing the linkage 30 to the skeg 20, and a universal joint 34 for securing the linkage 30 to the tugboat 14.

Figure 2:
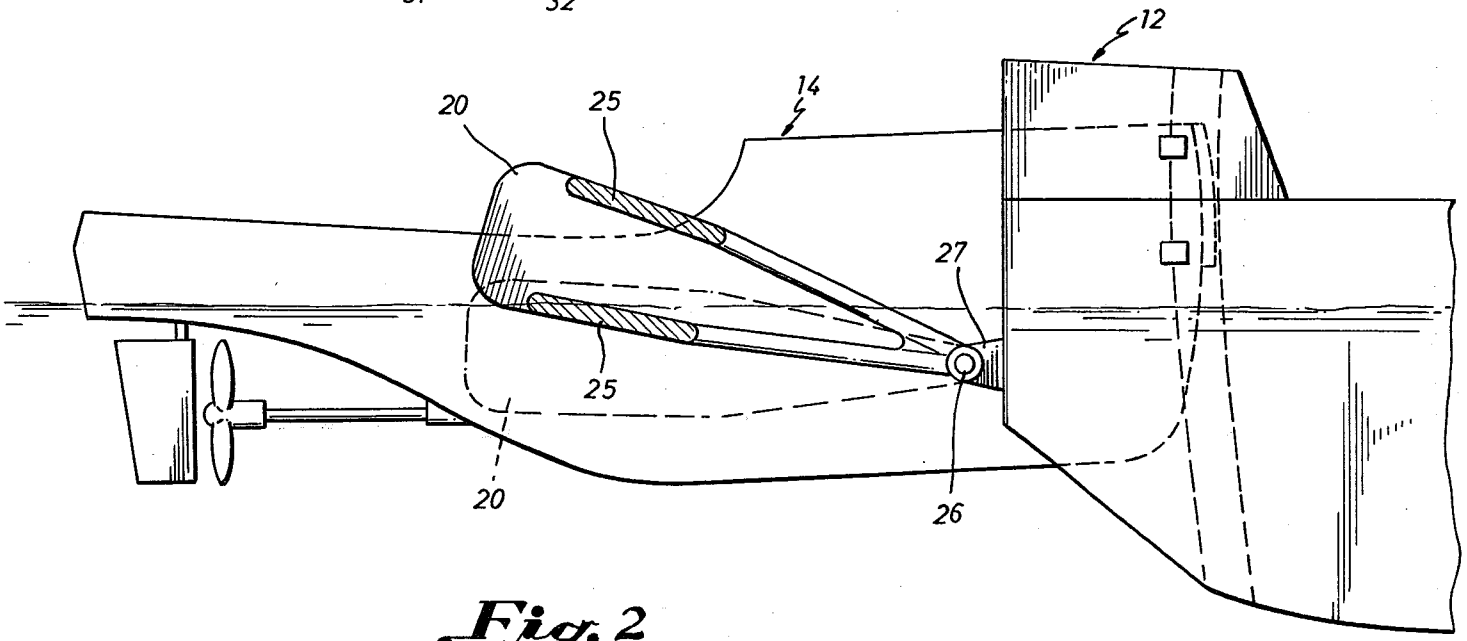
FIG. 2 is a cross-sectional view taken along plane 2—2 of FIG. 1 illustrating the skeg-arms connecting the tugboat-barge combination illustrated in FIG. 1.

Referring to FIGS. 1 and 2, the skeg 20 is comprised of metal or other suitable material and has a configuration having suitable surface area and water resistance to minimize yawing for a given barge. In the preferred embodiment, the skeg 20 is comprised of a steel shell having inner metal bracing, the shell having a triangular configuration having a substantially constant width. Other suitable materials having a requisite porosity, density and balance to maintain the skeg at a desired attitude when disengaged from a tugboat may be utilized, however, in accordance with this invention.

The skeg 20 is movably secured to the stern of the barge 12 by a connector 22 which accommodates the vertical movement of the end of the skeg 20. The connector 22 may comprise any of the number of suitable connecting devices providing for such vertical movement, whether rotational or linear. In the preferred embodiment, the connector 22 comprises a pin joint having a bracket 23 secured to the stern of the barge 12 such that the skeg 20 is secured by a pin 23A to the bracket 23 and rotates about the axis of the pin 23A.

Figure 3:
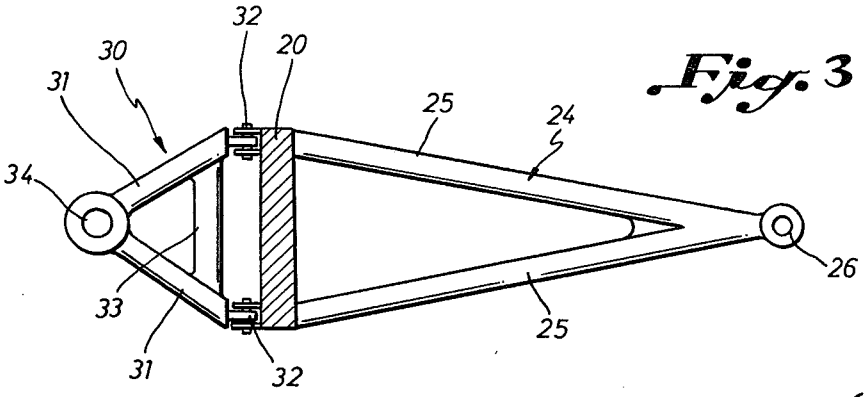
FIG. 3 is a cross-sectional view taken along plane 3—3 in FIG. 1 illustrating the relative positioning of the arm.

The skeg-linkage arm 10 further comprises a bracing support 24 angularly secured to the outer side of the skeg 20 and movably secured to the stern of the barge 12. The bracing support 24 may be comprised of any material having the suitable tensile strength to support the skeg 20 when being pulled through the water and having sufficient compressive strength to withstand the compression exerted by the tugboat against the bracing member 24 when the tugboat pushes against the skeg 20. In the preferred embodiment, as shown in FIG. 3, the bracing support 24 is comprised of two metal bars 25 angularly secured to the outer side of the skeg 20 such that the bars 25 both angle away from the skeg 20 and converge at a point near the stern of the barge. The bracing support bars 25 are movably secured to the barge by an opposing connector 26 which should be similar in construction and movement to the connector 22 by which the skeg 20 is secured to the barge. In this manner, the skeg 20 and bracing support 24 exhibit concerted motion and form a triangular support with each other.

The skeg-linkage arm 10 may further comprise a cross member 28 in order to further strengthen the skeg-bracing support assembly. In the preferred embodiment, the cross member 28 is comprised of a metal bar extending from the base of the skeg 20 where it connects to the barge, to the base of the bracing support 24, where it also connects to the barge.

Referring to FIGS. 1 and 3, the skeg-linkage 10 is further comprised of a connecting linkage 30 which is movably secured to the inner side of the skeg 20 by a third connector 32. In the preferred embodiment, the connecting linkage 30 is comprised of two bars 31 pivotally secured to the skeg 20 by the third connectors 32. The bars 31 are angularly oriented such that they converge to a point at which a universal joint 34 is secured. A brace member 33 may be further included at the opposite end such that the connecting linkage 30 also forms a triangular support for optimum strength.

Referring to FIG. 1, the third connectors 32 may be comprised of any of a number of suitable connectors providing for horizontal rotational movement of the connecting linkage 30 with respect to the skeg 20. In the preferred embodiment, the third connectors 32 are comprised of a pair of pin joints secured to the skeg 20. It should be understood by those with skill in the art, however, that other suitable connectors providing a movable connection may be utilized in accordance with the present invention.

Referring to FIG. 3, the skeg-linkage arm 10 further comprises a universal joint 34 which may be secured to the connecting linkage 30 for providing universal movement between the barge 12 and the tugboat 14. The universal joint 34 is further securable to the tugboat 14 by a suitable coupling (not shown) such as a flange, bayonet coupling, or other suitable means known to those of skill in the art for securing the universal joint 34 to the tugboat 14. In the preferred embodiment, the universal joint 34 is comprised of a ball and socket joint. It should be understood, however, that other suitable connectors may be utilized in order to provide the desired freedom of movement between the tugboat 14 and the linkage 30.

Accordingly, when the preferred embodiment is utilized, the skeg-linkage arm 10 is attached out of the water to the tugboat 14 at the universal joint 34 to accommodate the pushing of a barge 12 by the tugboat 14. When the barge 12 is to be pulled, however, the skeg-linkage arm 10 is allowed to drag in the water, thereby functioning as a skeg to minimize yawing. Further, in the preferred embodiment, the skegs 20 ride in a semi-submerged condition such as is shown, ghosted in, in FIG. 2. As will be understood by those of skill in the art, however, the skeg may ride at other suitable drafts in accordance with this invention.

In an alternative embodiment of the present invention, the movable skeg 40 comprises a unitary body 50, a connector 55 for movably securing the body 50 to the barge 12, a connecting linkage 60, a second connector 65 for securing the connecting linkage 60 to the unitary body 50, a universal joint 70 for securing the linkage to the tugboat 14, a flow flap 75, and a connector 77 securing the flow flap to the barge.

Figure 5:
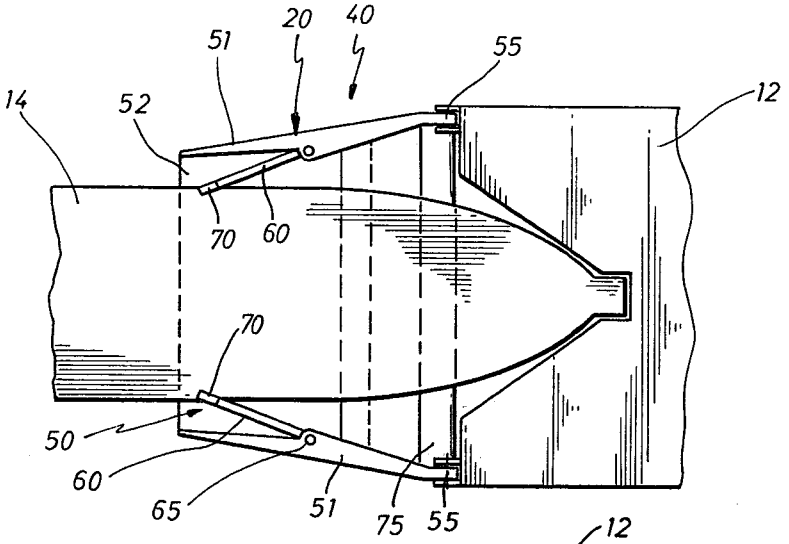
FIG. 5 is a plan view of the embodiment illustrated in FIG. 4.
Figure 4:
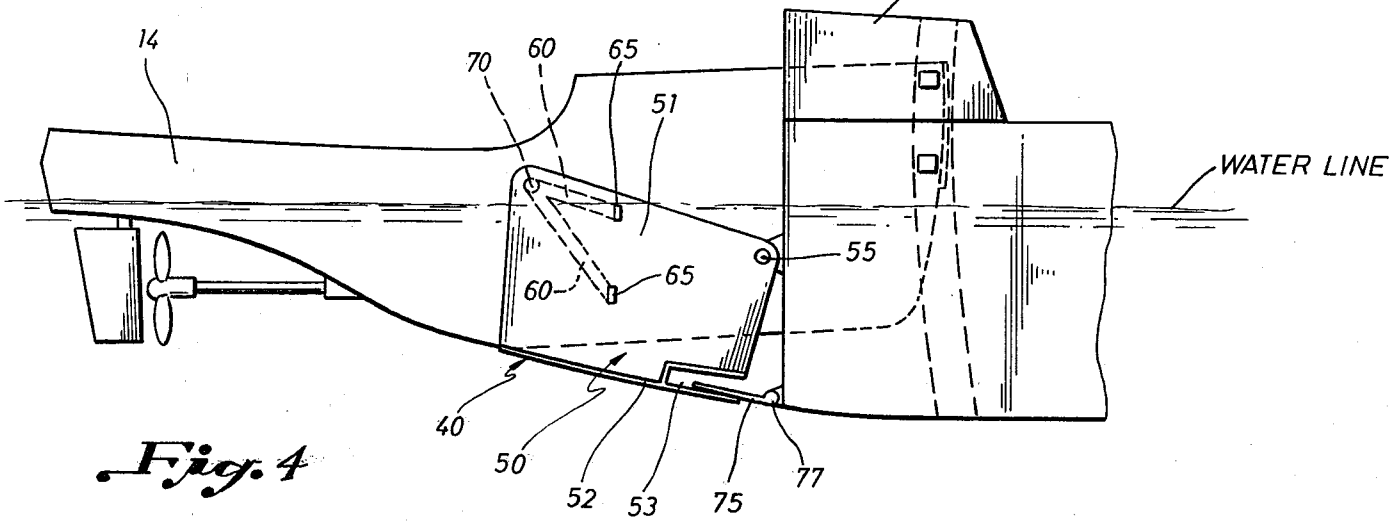
FIG. 4 is a side view illustrating an alternative embodiment of the present invention.

Referring to FIGS. 4 and 5, the unitary body 50 is comprised of metal or other suitable material and has a generally U-shaped configuration when viewed from the end, having opposing sides 50 and bottom 52, such that it wraps around the bottom of the tugboat 14. The opposing sides 51 of the unitary body 50 taper toward the sides of the tugboat 14 such that the unitary body 50 has a trapezoidal configuration in plan view with the wider base proximate the barge 12 as shown in FIG. 4.

The unitary body 50 further has a recess 53 positioned in each side 51 proximate the base 52 at a location proximate the stern of the barge 12 such that the open end of the recess 53 faces toward the stern of the barge 12. In the preferred embodiment, the recess 53 has a substantially rectangular configuration; however, it should be understood that the recess may have other suitable configurations in accordance with the present invention.

The unitary body 50 is movably secured to the stern of the barge 12 by a connector 55 which accommodates the pivotal movement of the unitary body 50 around an axis parallel to the end of the barge and the waterline. In the preferred embodiment, the connector 55 comprises a pin joint similar in construction to the pin joint described for the connector 22 above.

The movable skeg 40 may further comprise a flow flap 75 positioned between the bottom of the stern of the barge and the bottom 52 of the unitary body 50 in order to provide a continuous surface from the barge 12 to the end of the movable skeg 40 for water flow. In the preferred embodiment, the flap 75 is pivotally mounted parallel the bottom of the barge 12 by a plurality of connectors 77 which are similar in construction to the connector 55. The flap 75 has a generally rectangular configuration and is positioned such that the width or short side of the rectangle extends rearwardly and is received in the recess 53 of the respective sides 51. In operation, therefore, the flap 75 rides on the bottom 52 of the unitary body 50 for varying positions of the unitary body 50. It is believed that the discontinuity of water flow around the bow of the tugboat 14 will thereby be minimized by the unitary body 50.

The movable skeg 40 further comprises opposing connecting linkages 60 pivotally secured to the inside of the sides 51 such that they pivot inwardly to engage with the tugboat 14. The connecting linkages 60 are similar in construction to the connecting linkages 30 described above, and are secured to the sides 51 by connectors 65 similar in construction to the connector 32, above. The movable skeg 40 further comprises a universal joint 70 which is secured to the connecting linkage 60. The universal joint 70 is further securable to the tugboat 14 by a suitable coupling (not shown) such as a flange, bayonet coupling or other suitable coupling known to those of skill in the art.

Accordingly, when this embodiment is utilized, the unitary body 50 is ballasted in such a position that it minimizes yaw when the barge is pulled. Alternatively, when the barge is pushed, the unitary body forms a continuous surface between the barge and the tugboat in order to minimize water resistance between the barge and tugboat.

The instant invention has been disclosed in connection with specific embodiments. However, it will be apparent to those skilled in the art that variations from the illustrated embodiment may be undertaken without departing from the spirit and scope of the invention. For example, universal movement may be provided between the linkage 30 and the skeg 20, with suitable motion adjustments for other joints in the skeg-linkage 10. Additionally, the shape and size of the skeg may be altered to change the yaw characteristics of the barge as desired. Further, the position of the skeg could be modified to coincide with the position of the bracing support 24, with other suitable bracing arrangements for the skeg. Also, the skeg may be incorporated onto barge-tugboat combinations which have suitable provisions for minimizing roll of the tugboat relative to the barge when the tugboat pushes the barge. These and other variations will be apparent to those skilled in the art and are within the spirit and scope of the invention.

What is claimed is:

1. An apparatus for decreasing yaw of a first vessel when the first vessel is pulled by a second vessel comprising a fin of predetermined configuration adapted to be movably secured to the first vessel, extending rearwardly in use, the fin being adapted such that, when secured, the fin may be movable between a first position wherein the fin is in the water to decrease yaw when the first vessel is pulled by such a second vessel and a second position wherein the fin is positioned to decrease water resistance when the first vessel is pushed by a second vessel.

2. The apparatus of claim 1 wherein said frame further comprises a bottom assembly secured to the arms having a configuration such that the bottom assembly forms a substantially continuous surface between the first and second vessels in order to decrease water resistance when the second vessel is pushing the first vessel.

3. An apparatus for coupling first and second vessels when the first vessel is pushed by the second vessel, the apparatus permitting some freedom of movement of the first vessel relative to the second vessel when the vessels are coupled, and for reducing yaw of the first vessel when it is pulled by the second vessel, comprising:

(a) a frame adapted to be movably secured to the stern of the first vessel such that the frame may be selectively positioned in a first position when the first vessel is pulled by the second vessel and in a second position when the first vessel is pushed by the second vessel, the frame comprising a plurality of arms extending rearwardly in use from the first vessel;

(b) a skeg member operatively mounted on the frame to reduce yaw of the first vessel; and (c) a connector operatively associated with the frame, the connector being adapted to interconnect the second vessel and the frame when the frame is in the second position.

4. The apparatus of claim 3 wherein the frame comprises two arms adapted to be symmetrically disposed in use on opposite sides of the second vessel when the second vessel pushes the first vessel and wherein the frame further comprises a skeg member operatively mounted on each arm.

5. The apparatus of claims 3 or 4 wherein the connector comprises a universal connector for coupling the arm to the second vessel.

6. The apparatus of claims 3 or 4 wherein the arms have a triangular configuration having a first corner point oriented in use proximate the connector and second and third corner points oriented in use along the stern of the barge.

7. The apparatus of claims 3 or 4 wherein the skeg member comprises a steel body.

8. The apparatus of claims 3 or 4 wherein the skeg member comprises a metallic body, the body having a substantially triangular configuration having a substantially constant width and wherein the skeg member has an inner side proximate to the second vessel in use and an opposing outer side, wherein said connector comprises a connecting linkage pivotally secured to the inner side of the skeg such that the connecting linkage pivots inwardly from the skeg to contact the second vessel and a universal joint secured to the connecting linkage and adapted for securing the linkage to the second vessel and for providing limited universal motion of the connecting linkage and frame in relation to the second vessel.

9. The apparatus of claim 3 wherein the frame is adapted to be pivotally secured to the first vessel for pivotal displacement around a generally horizontally extending axis between the first and second positions.

10. The apparatus of claim 9 wherein the frame comprises a pin joint adapted to pivotally secure the frame to the first vessel.

11. An apparatus for coupling first and second vessels, comprising:

(a) a first skeg of predetermined configuration adapted to be movably secured to the stern of the first vessel, extending rearwardly from the first vessel, such that the first skeg may be moved from a first position, wherein the first skeg is in the water sufficiently to substantially reduce yawing, to a second position wherein the first skeg member is out of the water ; and (b) a second, opposing skeg of predetermined configuration adapted to be movably secured to the stern of the first vessel, extending rearwardly from the first vessel, such that it is positioned in use on the opposing side of the second vessel from the first skeg and such that the second skeg member may be moved from a third position, wherein the second skeg member is in the water sufficiently to substantially reduce yawing, to a fourth position wherein the second skeg member is out of the water when the second arm is secured to the second vessel;

(c) first means for selectively connecting the first skeg to the second vessel when it is in the second position; and (d) second means for selectively connecting the first skeg to the second vessel when it is in the fourth position.

12. The apparatus of claim 11 wherein the first and second skegs are symmetrically disposed relative to the sides of the second vessel.

13. The apparatus of claim 11 wherein the first and second skegs are hinged along an axis substantially parallel to the waterline to permit vertical movement of the skegs.

14. The apparatus of claim 13 wherein the first and second skegs each comprise a pin joint adapted to be secured to the first vessel and pivotally secured to the first and second skegs respectively.

15. The apparatus of claim 11 wherein said first and second connection means comprises a linkage secured to each skeg and a universal connector secured to each linkage, the linkage and universal connector being adapted for coupling each skeg to the second vessel when in the second and fourth positions respectively such that the first vessel is provided freedom of movement relative to the second vessel for a limited path of travel.

16. The apparatus of claim 11 wherein the first and second skegs each comprise a bracing support secured to the respective skeg and positioned such that the respective bracing support extends angularly from its skeg to form a triangular support configuration having a first corner point proximate to the respective point of securing each skeg to the second vessel and second and third corner points along the stern of the barge.

17. The apparatus of claim 11 wherein each skeg member comprises a steel body.

18. The apparatus of claim 11 wherein the first and second skeg members each comprises a steel body, the body having a substantially triangular configuration having a substantially constant width and wherein each skeg has an inner side for placement proximate the second vessel and an opposing outer side, wherein said first and second connecting means each comprise a connecting linkage pivotally secured to the inner side of each skeg such that the respective connecting linkages pivot inwardly from the respective skegs to contact the second vessel; and a universal joint secured to each connecting linkage for securing the respective linkage to the second vessel and for providing limited universal motion of the first vessel in relation to the second vessel.

19. A linkage apparatus for coupling a non-propelled barge to a tugboat, the apparatus permitting some freedom of movement of the barge in relation to the tugboat when the barge and tugboat are coupled for towing the barge by pushing it from the stern and alternatively functioning as a skeg for the barge when the barge is towed by the tugboat by pulling it, comprising:

(a) first and second opposing frames adapted to be pivotally secured to the stern of the barge such that said frames are adapted to be movable between a first position when the barge is pulled by such a tugboat and a second position when the barge is pushed by such a tugboat, each frame having an outer side and an inner side for placement proximate to the tugboat when the tugboat is in position for pushing the barge and each frame further comprising an arm adapted to extend rearwardly from the first vessel in use and to be secured to the second vessel on opposite sides of the second vessel, and each frame further comprising a bracing support angularly secured to each frame on the outer side of the frame such that the frame and bracing support form a triangle with the barge in use, each bracing support being adapted to be pivotally secured to the barge to accommodate motion of the bracing support in concert with its respective frame;

(b) a skeg secured to each arm, the skeg having a predetermined, substantially triangular configuration having a substantially constant width, said configuration being adapted to substantially reduce yawing of the barge when the frame is in the first position;

(c) a connecting linkage pivotally secured to the inner side of each frame such that the linkage pivots inwardly from the frame to contact the tugboat; and (d) a universal joint secured to each connecting linkage and adapted to secure the connecting linkage to the tugboat and to provide universal motion of limited magnitude to the barge in relation to the tugboat.

20. An apparatus for decreasing yaw of a first vessel when the first vessel is pulled by a second vessel and for interconnecting a first and a second vessel when the first vessel is pushed by the second vessel, comprising:

means for movably attaching the apparatus to such a first vessel such that the apparatus is adapted to be movable between a first position when the first vessel is pulled by the second vessel and a second position when the first vessel is pushed by the second vessel;

means of a predetermined configuration for substantially reducing yawing when the apparatus is in the first position; and means for connecting the apparatus to the second vessel when the apparatus is in the second position.

21. The apparatus of claim 20 wherein said attaching means includes a connector adapted to pivotally secure the apparatus to the stern of the first vessel such that the apparatus rotates around a generally horizontally extending axis.

22. The apparatus of claim 20 wherein said yaw reducing means of predetermined configuration includes a first fin operatively mounted on the apparatus to reduce yaw when the apparatus is in the first position.

23. The apparatus of claim 22 wherein said yaw reducing means further includes a second fin operatively mounted on the apparatus opposing said first fin to reduce yaw when the apparatus is in the first position.

* * * * *